US010014563B2

(12) United States Patent
Abdellatif et al.

(10) Patent No.: US 10,014,563 B2
(45) Date of Patent: Jul. 3, 2018

(54) TUNABLE PHASE SHIFTER COMPRISING A PHASE SHIFTING MECHANISM FOR ADJUSTING A DISTANCE OF A TRANSMISSION LINE AND/OR A DIELECTRIC PERTURBER TO EFFECT A PHASE SHIFT

(71) Applicant: C-COM SATELLITE SYSTEMS INC., Ottawa, Ontario (CA)

(72) Inventors: Ahmed Shehata Abdellatif, Waterloo (CA); Aidin Taeb, Kitchener (CA); Nazy Ranjkesh, Waterloo (CA); Suren Gigoyan, Waterloo (CA); Ahmed Kamal Said Abdelaziz, Waterloo (CA); Safieddin Safavi-Naeini, Waterloo (CA)

(73) Assignee: C-COM SATELLITE SYSTEMS INC., Ottawa (CA)

( * ) Notice: Subject to any disclaimer, the term of this patent is extended or adjusted under 35 U.S.C. 154(b) by 0 days.

(21) Appl. No.: 14/725,844

(22) Filed: May 29, 2015

(65) Prior Publication Data

US 2015/0372361 A1 Dec. 24, 2015

(30) Foreign Application Priority Data

May 30, 2014 (CA) ..... 2852858

(51) Int. Cl.
*H01P 1/18* (2006.01)

(52) U.S. Cl.
CPC ..... *H01P 1/184* (2013.01)

(58) Field of Classification Search
CPC .... H01P 1/184; H01P 1/18; H01P 9/00; H01P 9/006
USPC ..... 333/161
See application file for complete search history.

(56) References Cited

U.S. PATENT DOCUMENTS

| | | | | |
|---|---|---|---|---|
| 5,905,462 | A | 5/1999 | Hampel et al. | |
| 6,987,488 | B1 * | 1/2006 | Chang et al. | H01P 1/184 333/161 |
| 2008/0048800 | A1 * | 2/2008 | Dutta | H01L 23/66 333/161 |
| 2009/0033438 | A1 * | 2/2009 | Chang et al. | H01P 1/184 333/161 |

* cited by examiner

*Primary Examiner* — Benny Lee
(74) *Attorney, Agent, or Firm* — Pearne & Gordon LLP

(57) ABSTRACT

A tunable phase shifter is provided which includes a dielectric substrate, a transmission line formed based on the dielectric substrate for carrying input and output signals and a dielectric disturber placed on top of the transmission line. The phase shifter further includes a phase shifting mechanism for adjusting at least one of a distance between the transmission line and the substrate and a distance between the transmission line and the dielectric disturber to effect phase shift.

14 Claims, 20 Drawing Sheets

TUNABLE PHASE SHIFTER COMPRISING A PHASE SHIFTING MECHANISM FOR ADJUSTING A DISTANCE OF A TRANSMISSION LINE AND/OR A DIELECTRIC PERTURBER TO EFFECT A PHASE SHIFT

CROSS-REFERENCE TO RELATED APPLICATIONS

This application claims priority to, Canadian Application No. 2,852,858, filed May 30, 2014, the contents of which are incorporated by reference herein in its entirety.

TECHNICAL FIELD

The present invention relates to phase shifters, and particularly to tunable phase shifters.

BACKGROUND

Phased array technology is rapidly advancing and targeting a number of applications in the millimeter-wave/sub-THz ranges. Examples of such applications include satellite communications, automotive radar, 5G cellular communications, imaging and sensing. This type of applications makes use of antennas with beam-steering capability which can be realized with phased array antennas. High performance integrated phase shifters are important components in the millimeter-wave/sub-THz phased array antenna systems.

Beam-steering focuses the electromagnetic energy in a specific direction, which may be used to increase the signal to noise or interference ratio, reduce the system overall power consumption and/or increase the channel throughput. Beam-steering in phased array is mainly achieved by the phase shifters which introduce progressive linear phase difference between antenna elements. Depending on the relative values of these phase shifts the antenna beam responds by being steered towards a specific direction.

The main drawback of utilizing passive phase shifters in such applications lies in the fact that the insertion loss changes remarkably with the introduced phase shift. Higher insertion loss variation leads to a significant distortion of the radiation pattern while the beam is being steered. Using variable gain amplifiers/attenuators to compensate for the change in the phase shifter insertion loss is one way to solve this problem; however, this approach adds to the design complexity, overall cost, power consumption and/or noise level of the integrated system.

For active phased arrays with a high precision beam pointing, each individual antenna element may be integrated with its own phase shifter. This imposes a stringent size constraint on the total foot print of the phase shifting element. For example, for Ka-band phased arrays operating at a frequency of 30 GHz, each phase shifter with its active and passive peripherals may occupy only an area of less than 5 mm*5 mm. Commercial phased array systems also desire low cost integration and fabrication. The size limitation and the lack of a low cost packaging solution for mass-production in some existing solutions make them difficult for the use of large commercial phased arrays.

SUMMARY OF THE INVENTION

The present invention therefore aims to design an improved tunable phase shifter that addresses at least some of the above problems. According to one embodiment of the invention, a tunable phase shifter is provided based on electromagnetic mode-convertion that can be used in microwave/millimeter-wave or millimeter-wave/sub-THz frequency ranges.

According to one aspect of the invention, a tunable phase shifter is provided which includes a dielectric substrate, a coplanar waveguide (CPW) transmission line formed above the dielectric substrate for carrying input and output signals, a dielectric perturber placed above the transmission line, and a phase shifting mechanism for adjusting at least one of a distance between the transmission line and the substrate and a distance between the transmission line and the dielectric disturber to effect phase shift.

According to another aspect of the invention, a tunable phase shifter is provided which includes a dielectric substrate, a CPW transmission line formed above the dielectric substrate for carrying input and output signals, and a MEMS actuator for adjusting a distance between to the transmission line and the dielectric substrate to provide phase shift.

According to another aspect of the invention, a tunable phase shifter is provided which includes a dielectric substrate, an image guide formed above the dielectric substrate for carrying input and output signals, a dielectric perturber placed above the image guide, and a phase shifting mechanism for adjusting at least one of a distance between the image guide and the substrate and a distance between the image guide and the dielectric disturber to effect phase shift.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

These and other features of the invention will become more apparent from the following description in which reference is made to the appended drawings.

DETAILED DESCRIPTION OF THE INVENTION

Figure 1A:
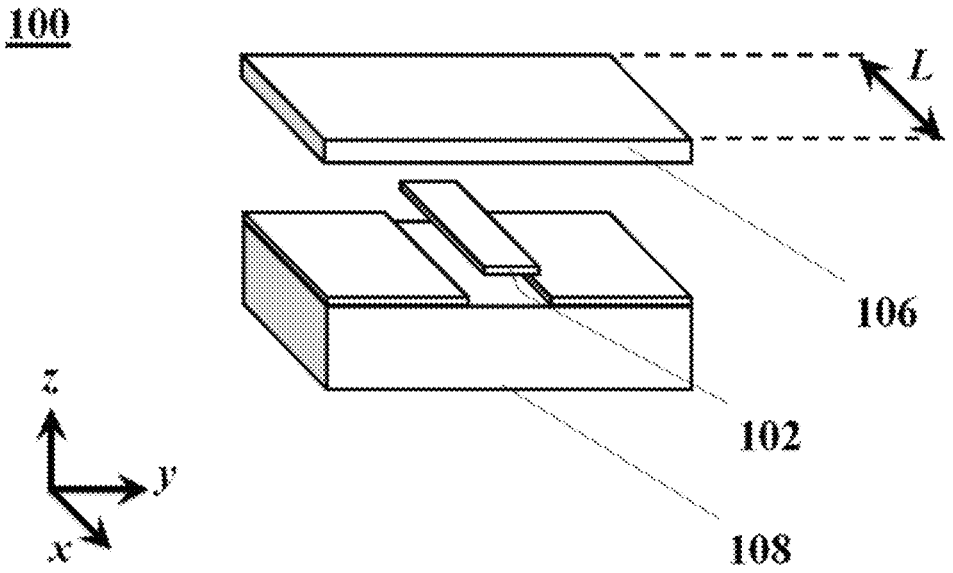
FIG. 1A provides a schematic diagram of a 3D model of the phase shifter according to one embodiment of the invention.

Although the following detailed description contains, for the purposes of explanation, numerous specific details in order to provide a thorough understanding of the preferred embodiments of the invention. It is apparent, however, that the preferred embodiments may be practiced without these specific details or with an equivalent arrangement. The description should in no way be limited to the illustrative implementations, drawings, and techniques illustrated below, including the exemplary designs and implementations illustrated and described herein, but may be modified within the scope of the appended claims along with their full scope of equivalents.

Traditional passive phase shifters have high loss variation with phase changing. When the passive phase shifters are used in phased array antennas, the antenna beam (radiation pattern) can be highly distorted while steering the beam. As well, passive phase shifters at millimeter-wave frequency range may have high average insertion loss to account for.

According to one aspect of the invention, an approach for phased arrays is exploited that allows building a tunable phase shifter exhibiting relatively small average insertion loss as well as small insertion loss variation throughout the tuning range. This leads to a simple, low cost and low power consumption system.

According to one aspect of the invention, a phase shifter is provided including a dielectric substrate, a transmission line formed based on the dielectric substrate for carrying input and output signals, and a dielectric perturber (e.g., dielectric slab) placed on top of the transmission line. A phase shifting mechanism is provided for adjusting at least one of a distance between the transmission line and the substrate and a distance between the transmission line and the dielectric perturber to effect phase shift. The phase shift may be tunable by reconfiguring the phase shifter components via physical actuation.

According to some embodiments of the invention, the transmission line may be a micro-strip line, a coplanar waveguide (CPW), or other planar transmission lines. In alternative embodiments, the transmission line may be an image guide, particularly high resistivity silicon (HRS)-based image guide. According to some embodiments of the invention, the dielectric perturber may be based on materials with high dielectric constant, such as Barium Lanthanide Tetratitanates (BLT) material, to achieve high phase shifts in a compact size.

A movement mechanism may be provided in the phase shifter for moving either the transmission line, the dielectric perturber, or both to provide the phase shift. The movement mechanism may be in the form of a micro-positioner, piezoelectric transducer, and/or micro-electromechanical systems (MEMS) actuator. The actuation mechanism or device to provide mechanical movement may be analog or electrically controlled.

Alternatively, instead of integrating a piezoelectric actuator or MEMS actuator, the distance between to a CPW transmission line and a BLT-based dielectric slab can be controlled by applying voltage directly on the dielectric slab made of BLT ceramics. Since dielectric slab possesses piezoelectric properties, it expands with voltage introducing a change in the air gap which leads to a variable phase shift.

The phase shifter according to various embodiments may also include an actuator attachment to the dielectric perturber, or matching sections to provide wide band characteristics.

As illustrated in the embodiment shown in FIG. 1A, a phase shifter 100 is provided including a dielectric substrate 108 formed along the x-y plane, a planar transmission line 102, and a dielectric perturber 106 (with a length of L). At least one of the planar transmission line 102 and the dielectric perturber 106 may be movable to provide the phase shift.

Figure 1B:
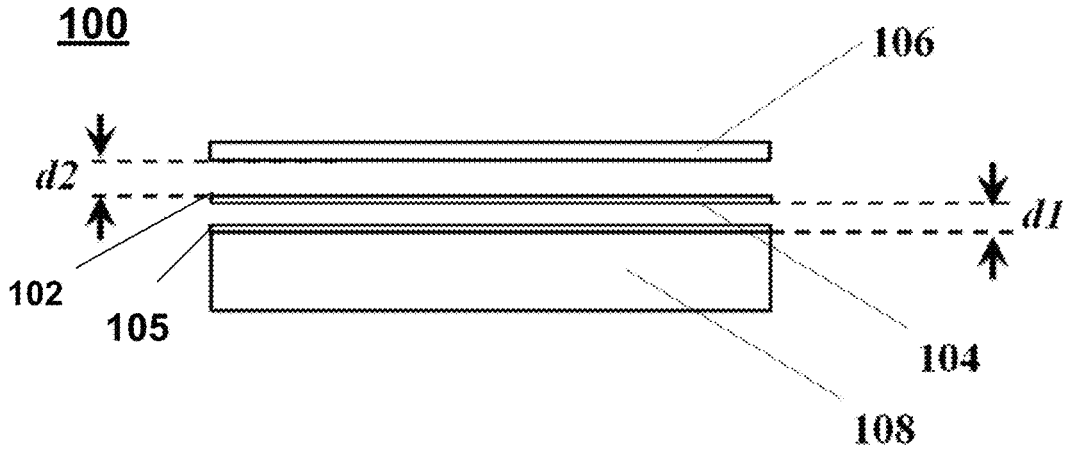
FIG. 1B provides a schematic diagram of a side view of the phase shifter according to one embodiment of the invention.

As shown in FIG. 1B, the transmission line 102 (FIG. 1A) is a CPW transmission line having a signal line 104 (e.g., a metal conductor) and a ground 105 (e.g., a metal ground). The signal line 104 can be actuated out-of-plane (e.g., along z-direction as shown in FIG. 1A) by a displacement (d1) as shown in FIG. 1B away from the substrate 108 of the transmission line 102. The substrate 108 is constructed by a first dielectric with a dielectric constant ($\varepsilon_{r1}$). Above the CPW transmission line 102, a dielectric slab 106 (a second dielectric with dielectric constant ($\varepsilon_{r2}$)) is positioned at a distance (d2) as shown in FIG. 1B from the signal conductor 104. At least one of the signal conductor 104 and the dielectric perturber 106 is movable relative to the substrate 108 so that either or both of the displacements d1 and d2 can be adjusted.

By controlling d1, d2 or both, signals propagating on the CPW transmission line 102 can be converted into a new propagation mode, mainly confined in the air region between the CPW metallization and the dielectric perturber slab made of a very high dielectric. This mode has minimal penetration into the very high dielectric constant material and its propagation constant ($\beta$), can be tuned by changing the air gap between CPW and the perturber slab. By changing the propagation constant, the phase shift can tuned.

Figure 1C:
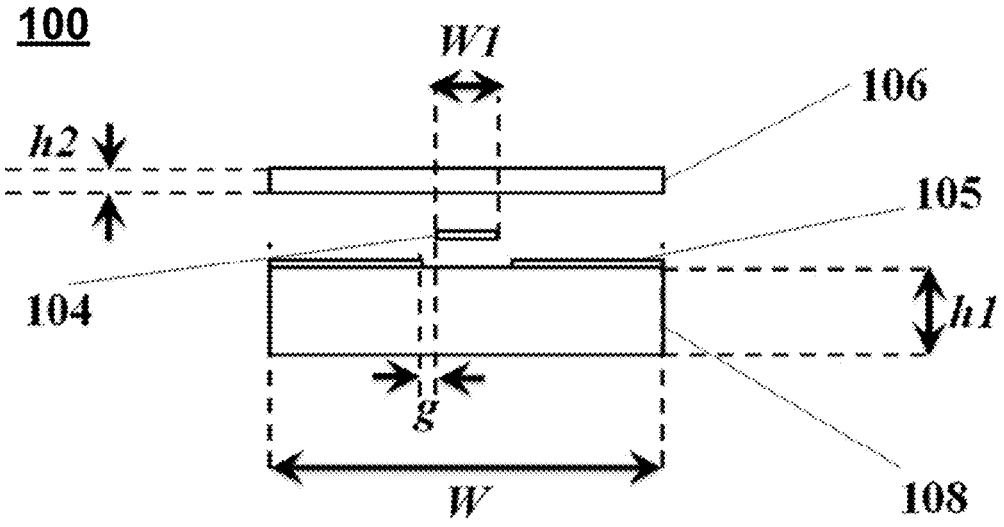
FIG. 1C provides a schematic diagram of a front view of the phase shifter according to one embodiment of the invention.

FIG. 1C illustrates a cross-sectional view of the phase shifter 100 taken along the y-axis shown in FIG. 1A. The height or thickness of the substrate 108 is represented by h1 and the height or thickness of the movable dielectric perturber 106 is represented by h2. The signal line 104 has a width (W1) and is separated from the ground 105 along the y-axis by a gap (g). The width of the substrate is represented by W.

With the fact the new mode in the region where the dielectric slab is close to CPW is Quasi-TEM, the propagation constant ($\beta$) of this new mode satisfies: $\beta=k_0\sqrt{\varepsilon_{eff}}$, where $k_0$ is the wave number in free space and $\varepsilon_{eff}$ can be considered as the effective dielectric constant of the propagation mode. This leads to a change ($\Delta\varphi$) in the phase ($\varphi$) proportional to a change $\Delta\beta$ of the propagation constant ($\beta$) satisfying the relationship of $\Delta\varphi=\Delta\beta\times L$, where L is the length of the phase shifter device 100. A small displacement (e.g., a few microns) with the proper choice of the dielectrics can be sufficient to obtain a full range of phase shift for a device length (L) as shown in FIG. 1A in the order of the wavelength.

Phase shifters which incorporate CPW transmission lines are easier to integrate with millimeter-wave CPW circuits using flip-chip bonding technique. Moreover, their testing is simpler than micro-strip-based devices, using the on-wafer probers without transitions or VIAs, which may be costly and deteriorate the performance of the circuit.

According to one simplified embodiment, the phase shifter 100 may be realized by setting d1 to zero, while d2 is variable. In this embodiment, the phase shift can be introduced by moving the dielectric perturber 106 on top of a normal CPW transmission line 102.

According to another simplified embodiment, the dielectric perturber 106 may be replaced with air. In this embodiment, the phase shift can be introduced by moving the signal line 104 of the CPW transmission line 102 vertically with respect to the substrate 108 (i.e., d1 is variable).

The phase shifter 100 according to various embodiments can be used in passive array antenna applications and can include a number of different designs.

Example 1

Figure 2:
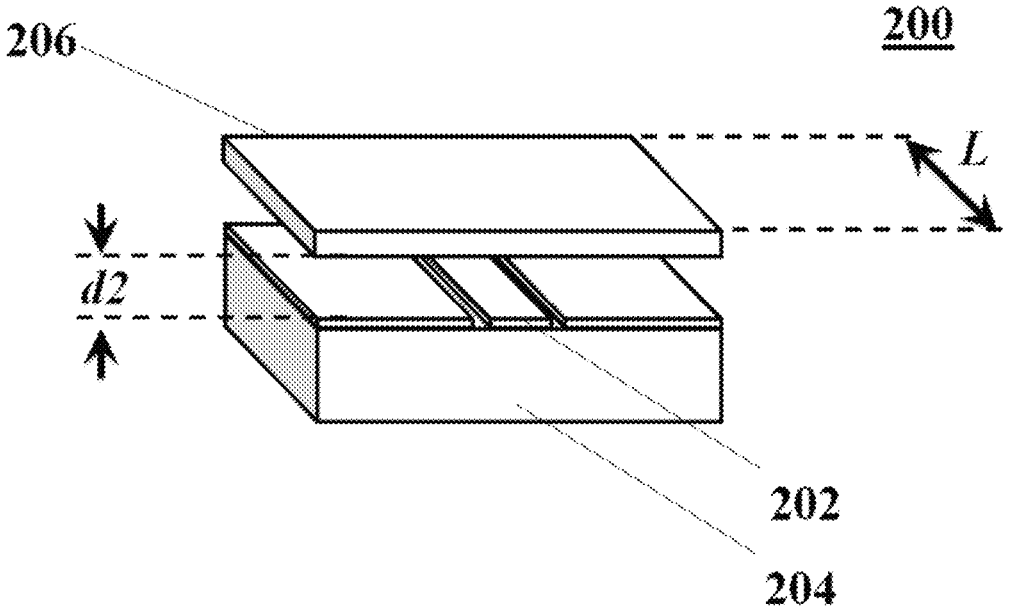
FIG. 2 provides a 3D model of the phase shifter according to an embodiment of the invention.

According to the design of Example 1, a phase shifter 200 is provided to be used in Ka-band car to satellite phased array. In this example, the phase shifter 200 may be designed for 30 GHz frequency use. As shown in FIG. 2, the parameter d1 is zero and fixed, whereas d2 is variable creating the tunable air gap for adjusting the phase shift. L is the length of the phase shifter device 200.

HRS material (e.g., with resistivity ≥2 KΩ·cm) may be used for the CPW substrate 204 to have a low loss and a smooth and planar surface. In this particular example, the used FIRS substrate has a thickness (h1) of 500 μm, a dielectric constant ($\varepsilon_{r1}$) of 11.8 and a resistivity of 2 KΩ·cm.

According to the example, the CPW line conductors 202 are made of Aluminum with a thickness (t) of e.g., 1 μm. The signal line width (W1) and the gap (g) are designed to provide a desired input impedance. In this particular example, W1 is 50 μm and g is 35 μm.

According to the example, BLT material may be used as the dielectric perturber 206 to provide high dielectric constant for sensitivity and compactness of the device. The BLT ceramics, made of $BaO\text{-}Ln_2O_3\text{—}TiO_2$ compounds (where Ln=La, Ce, Pr, Nd, Sm and Eu), are characterized by high dielectric constant ($\varepsilon_r$=40-170), low loss (tan $\delta=10^{-4}\text{-}10^{-3}$), and high thermal stability over a wide range of frequencies.

Figure 3:
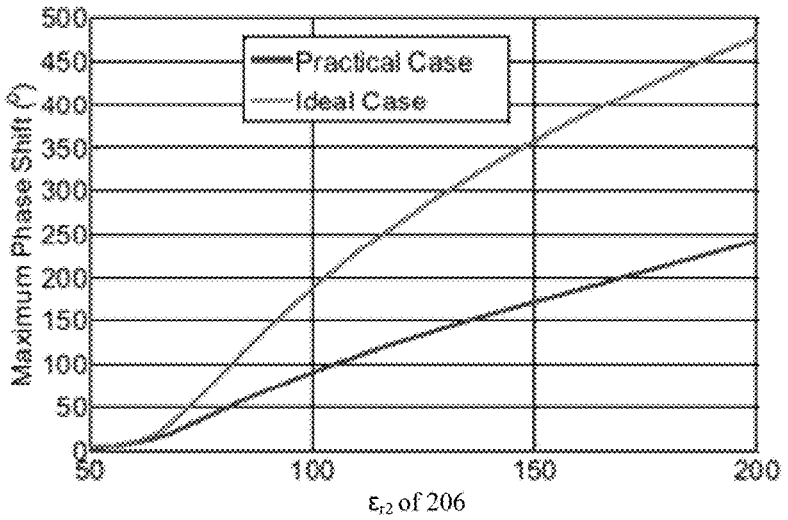
FIG. 3 illustrates a maximum phase shift as a function of the dielectric constant of the dielectric perturber, according to an embodiment of the invention.

The higher the dielectric constant of the BLT used, the higher the maximum phase shift that can be obtained from the phase shifter 200. FIG. 3 shows the maximum phase shift (in°) as a function of the dielectric constant ($\varepsilon_{r2}$) of the dielectric perturber (superstrate) 206 in FIG. 2 for two cases: 1) where the air gap (d2) can be reduced to zero (an ideal case), and 2) where the minimum gap size is limited by practical considerations (e.g., 3 μm) (a practical case). The values of FIG. 3 are calculated using the spectral domain modal analysis.

Figure 4A:
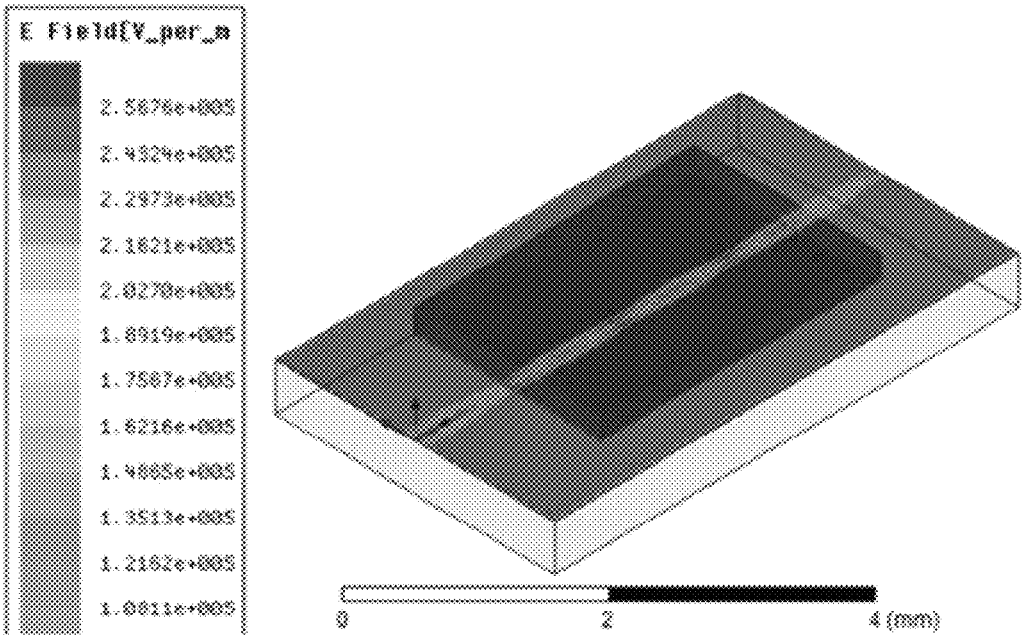
FIG. 4A illustrates a 3D E-field magnitude distribution of the phase shifter for 1 μm air gap, and 10 μm air gap, according to an embodiment of the invention.
Figure 4B:
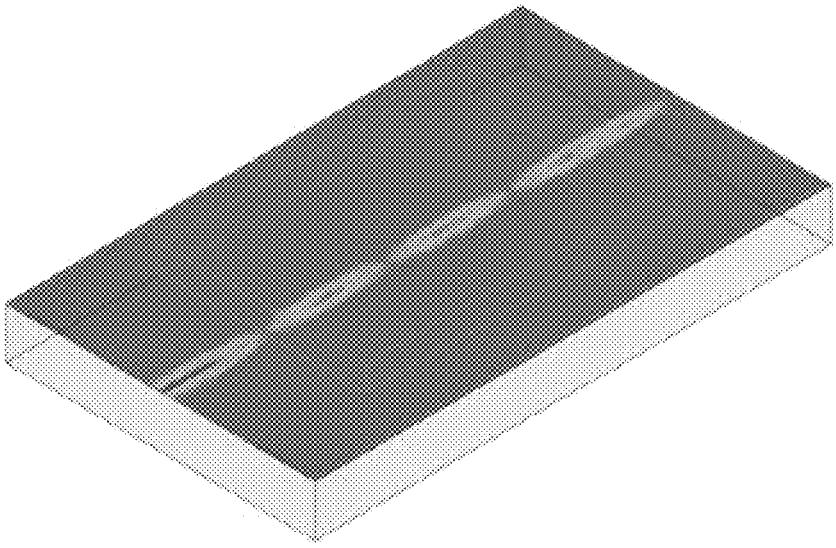
FIG. 4B illustrates a 3D E-field magnitude distribution of the phase shifter for 1 μm air gap, and 10 μm air gap, according to an embodiment of the invention.

In this particular example, the BLT slab 206 shown in FIG. 2 has a dielectric constant ($\varepsilon_{r2}$) of 100, a length (L) of 3 mm, and a thickness (h2) of 300 μm. As shown in FIG. 3, the theoretical value for the maximum phase shift for this device is 200°. However, the practical value is less, as will be shown later. The operation principle can be explained by FIG. 4A and FIG. 4B which shows the E-field magnitude distribution (in volt per meter (V/m)) at 30 GHz for two different air gap values: (a) 1 μm air gap as shown in FIG. 4A, and (b) 10 μm air gap as shown in FIG. 4B. Small changes in the air gap (d2) result in changing of the electrical length and therefore the total phase shift.

According to some embodiments, a low cost, high precision and repeatable fabrication process, which includes photolithography and wet etching, is used to fabricate the HRS CPW line 202 of the phase shifter 200. The BLT slab 206 can be cut using a laser machine, which can be accurate, chemical-free, and fast. A single-mask process is developed for the fabrication of the CPW line 202. The process includes standard steps and recipes to achieve both low cost and reproducibility. According to one particular embodiment, the substrate is a double-sided polished HRS wafer with a 4 inch diameter and a thickness of 500 μm±10 μm.

Figure 5:
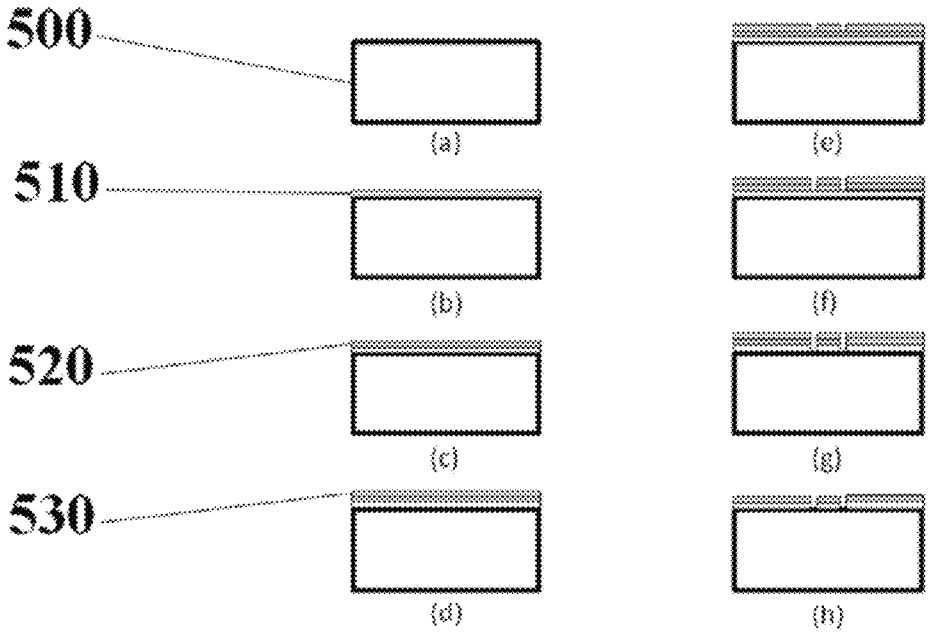
FIG. 5 illustrates a fabrication process of a CPW-based phase shifter, according to one embodiment of the invention.

FIG. 5 illustrates the process steps to fabricate a CPW-based phase shifter 200 (FIG. 2), according to one embodiment of the invention. The HRS wafer 500 is first cleaned at step (a) through a RCA1 process (also referred to as "standard clean-1") for removing any organic residues and particles. At step (b) a thin layer 510 of Cr (e.g., 10 nm) may be coated as an adhesion. Subsequently the method includes (c) sputtering of a Cu layer (e.g., 1 μm) to form a metal layer 520. Then, at step (d) the Cu surface is coated with a thin photo-resist 530 (Shipley 1811) with a thickness of for example about 1.6 μm using a spinner. At step (e) optical lithography with a Chrome mask is performed to pattern the photo-resist layer 530 which is now acting as a mask for etching the metal layer 520. Wet etching of the metal layer 520 is subsequently performed at step (f) which forms the CPW metallic patterns on the HRS wafer 500. At step (g), wet etching of the Cu is performed forming the CPW metallic patterns on the HRS wafer. Finally, at step (h) the photo-resist mask 530 is removed with acetone.

While the Cr/Cu combination is used for the metal layer 520 in this particular embodiment, Al may also be used for the CPW line 200. The metal deposition step then can be done by evaporating (electron-beam deposition) a layer of Al (e.g., 1-μm thick) instead of Cr/Cu on the HRS wafer 500.

Figure 6:
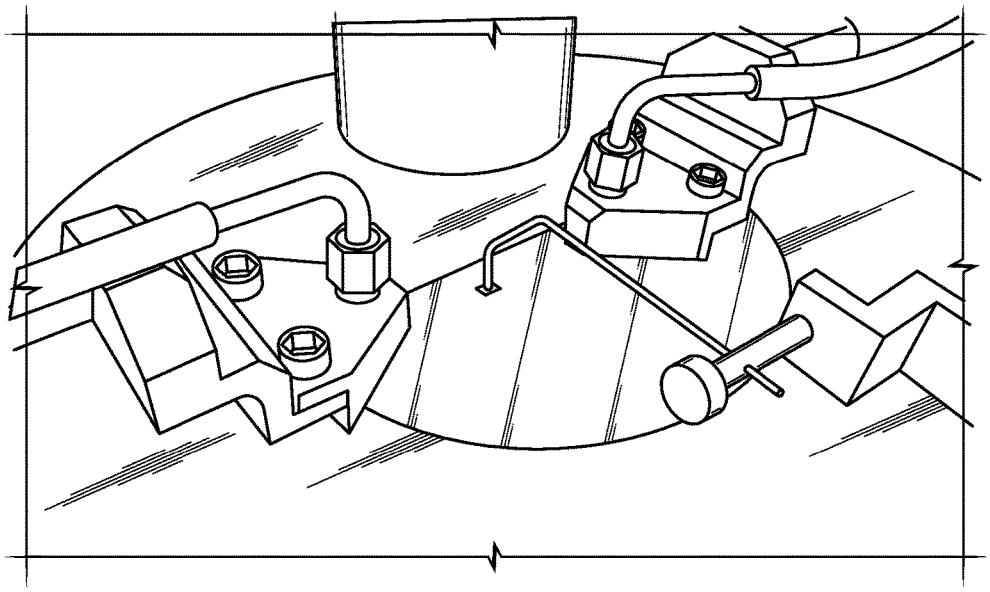
FIG. 6 provides an illustration of the experimental setup, according to an embodiment of the invention.

FIG. 6 shows an experimental setup to measure the phase shifter 200 (FIG. 2) according to an embodiment of the invention. In this experiment, a BLT slab is moved up and down using a micro-positioner. Therefore, the air gap can be varied for changing the propagation constant (β) and in turn the phase (φ).

Figure 7:
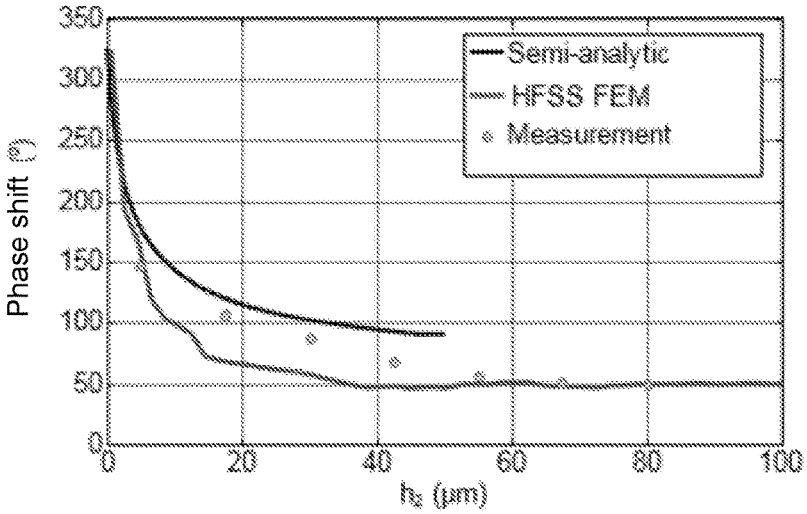
FIG. 7 provides measured and simulated phase variations as a function of the air gap, according to an embodiment of the invention.

FIG. 7 illustrates the simulated and measured phase shift values (in°) as a function of the air gap h2 in μm at 30 GHz. The measurement (in dots) is shown in comparison with a semi-analytic result and a simulation result by the high frequency structural simulator (HFSS) finite element method (FEM). As can be observed, the first measured value may be at 4 μm which is the minimum air gap h2 that can be realized for this particular setup. This value may be limited by the surface roughness of both the CPW transmission line 202 and the BLT slab 206. Also, it may be limited to the environment. The cleaner the setup is, the smaller the air gap that may be achieved.

Figure 8:
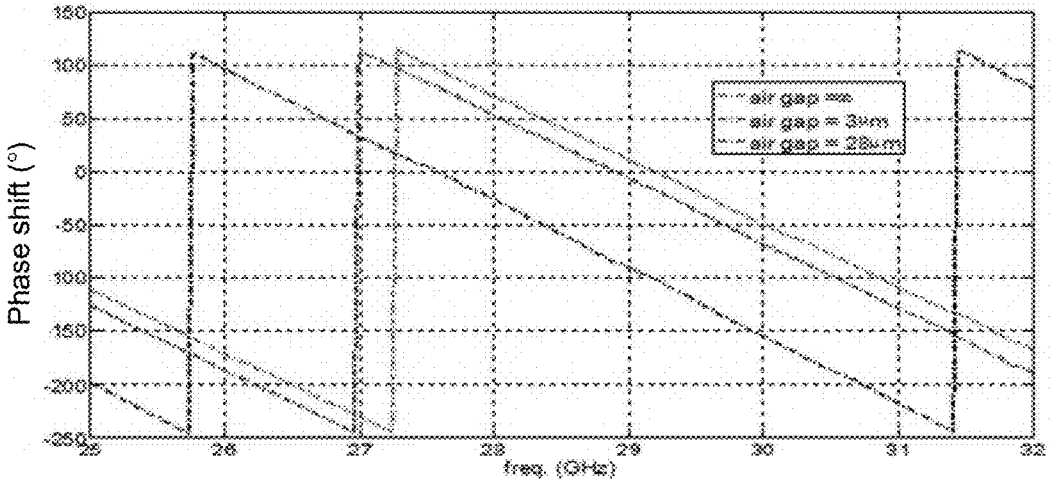
FIG. 8. provides a measured phase variation as a function of the frequency for different air gaps, according to an embodiment of the invention.
Figure 9:
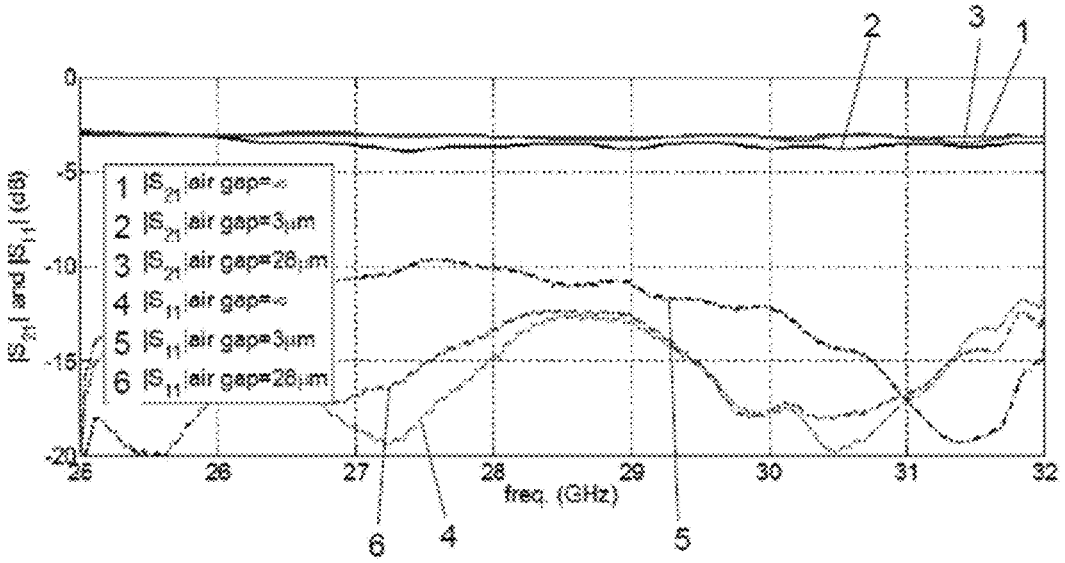
FIG. 9 provides a measured $S_{21}$ and $S_{11}$ magnitude variation as a function of the frequency for different air gaps, according to an embodiment of the invention.

Some test results are shown in FIGS. 8 and 9. FIG. 8 shows a measured phase shift (in°) as a function of the frequency (in GHz) for air gaps of infinity, 3 μm, and 28 μm, respectively, according to an embodiment of the invention. FIG. 9 shows a measured $S_{21}$ (designed as 1, 2, and 3) and $S_{11}$ magnitude variation (in dB) (designed as 4, 5, and 6) as a function of the frequency (in GHz) for air gaps of infinity, 3 μm, and 28 μm, respectively, according to an embodiment of the invention. The maximum phase shift obtained at 30 GHz may be 100° with an insertion loss variation of 0.7 dB.

Example 2

According to the design of this example, a phase shifter is provided with a structure and an experimental setup similar to Example 1. The only difference is that the BLT slab 206 in this example has a dielectric constant ($\varepsilon_r$) of 150.

Figure 10:
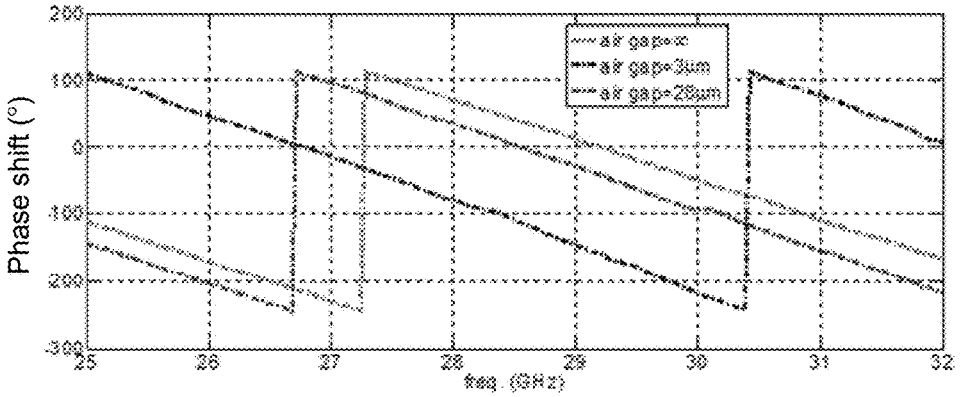
FIG. 10 provides a measured phase variation as a function of the frequency for different air gaps, according to an embodiment of the invention.
Figure 11:
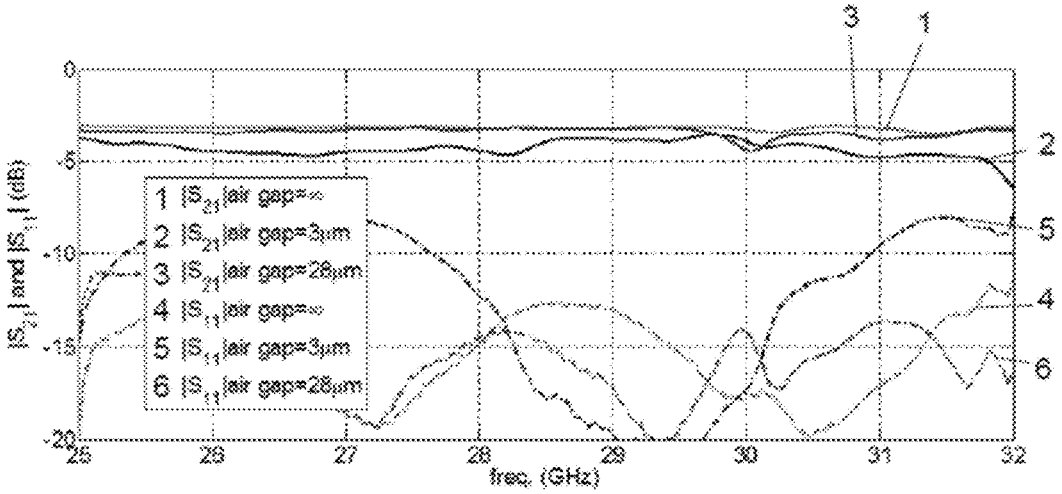
FIG. 11 provides a measured $S_{21}$ and $S_{11}$ magnitude variation as a function of the frequency for different air gaps, according to an embodiment of the invention.

FIG. 10 shows the measured phase shift (in°) as a function of the frequency (in GHz) for air gaps of infinity, 3 μm, and 28 μm, respectively, for this example; and FIG. 11 shows the measured $S_{21}$ (designed as 1, 2, and 3) and $S_{11}$ (designed as 4, 5, and 6) magnitude variation (in dB) as a function of the frequency (in GHz) for air gaps of infinity, 3 μm, and 28 μm, respectively, for this example.

Example 3

Figure 12A:
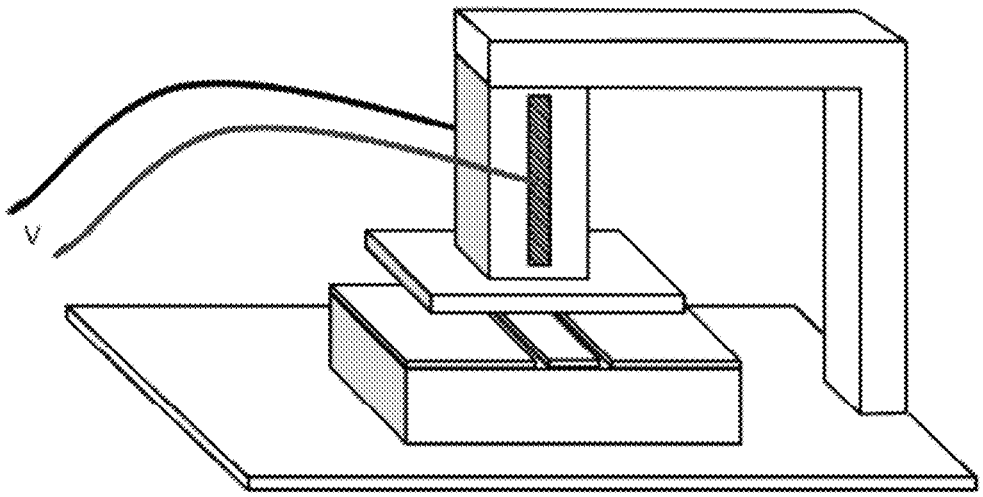
FIG. 12A provides a schematic diagram of a 3D model of the phase shifter with a piezoelectric transducer according to an embodiment of the invention.
Figure 12B:
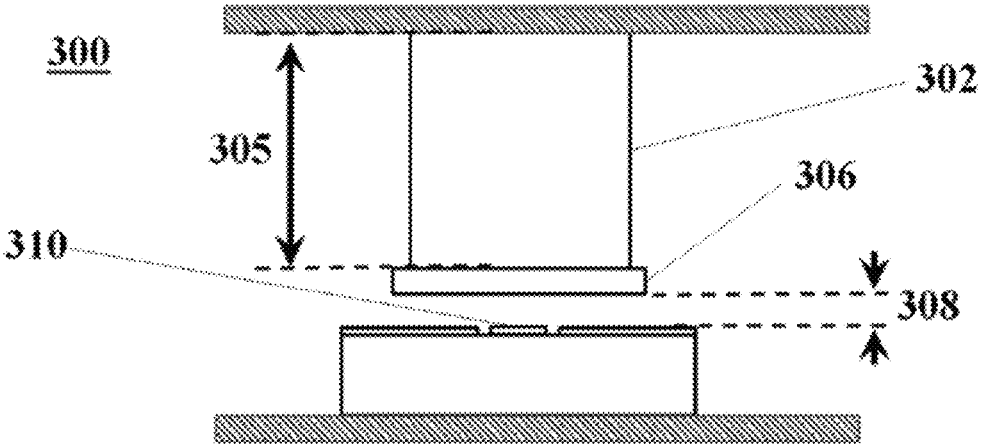
FIG. 12B provides a schematic diagram of a side view of the phase shifter with a piezoelectric transducer according to an embodiment of the invention.

According to the design of this example, a phase shifter 300 (FIG. 12B) is provided with an electrically controlled moving mechanism. FIG. 12A is a schematic diagram of the 3D model of the phase shifter. FIG. 12B is a side view of the phase shifter. As shown in FIG. 12B, the electrically controlled moving mechanism includes a displacement piezoelectric transducer 302 (FIG. 12B) replacing the micro-positioner in Example 1, such as a 11 μm displacement piezoelectric transducer.

Figure 13:
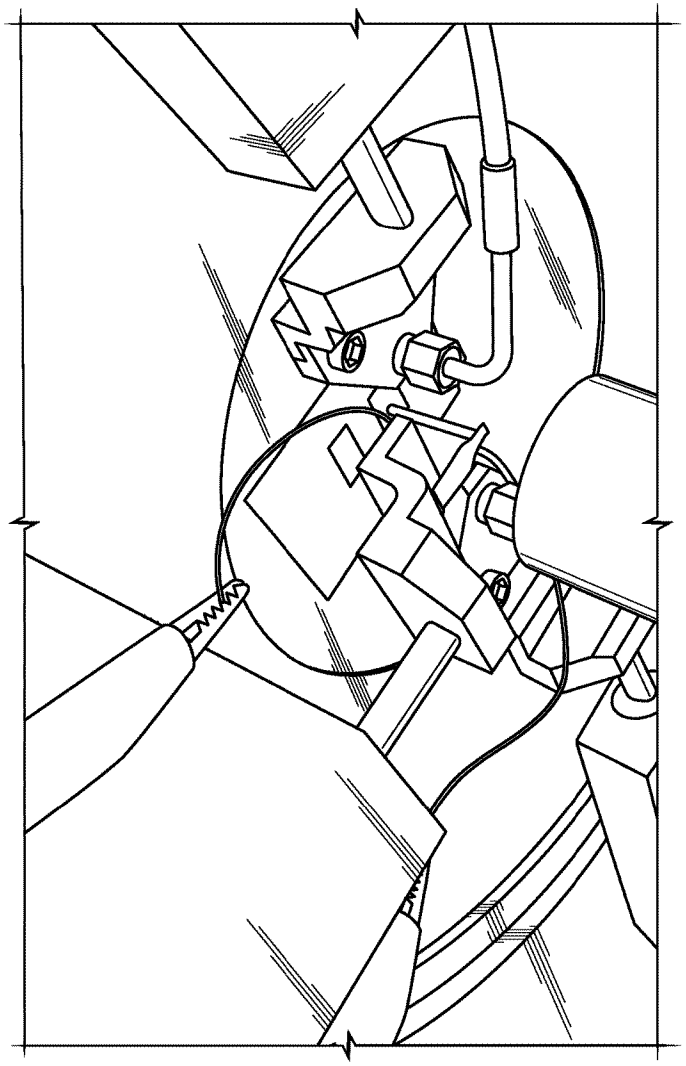
FIG. 13 provides an experimental setup for the piezoelectric-transducer-based phase shifter, according to an embodiment of the invention.

As shown in FIG. 12B, to configure the phase shifter 300 according to the embodiment, a polished cleaned surface of a BLT slab 306 may be placed on top of a HRS CPW transmission line 310, to obtain a maximum air gap 308 (e.g., 0.5~0.7 μm) between the two parallel surfaces. Then the piezoelectric transducer 302 is attached to the top surface of the BLT slab 306 and a maximum voltage is applied. This will result in a minimum air gap 308 position. By lowering the voltage or turning off the piezoelectric transducer 302, the BLT slab 306 is moved in the vertical direction 305 and the air gap 308 can be increased. FIG. 13 illustrates an experimental setup of the phase shifter according to the embodiment.

Figure 14:
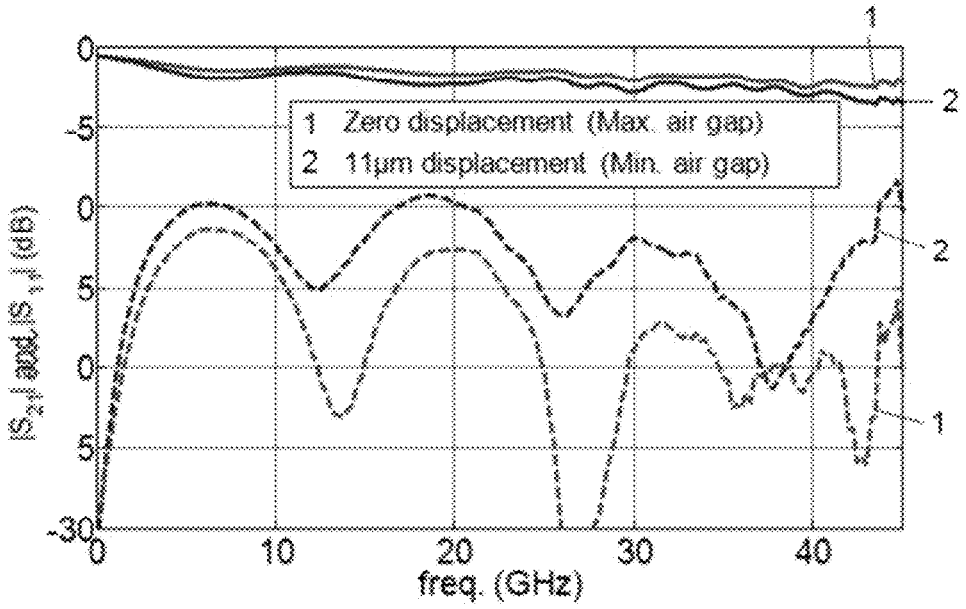
FIG. 14 provides a measured $S_{21}$ and $S_{11}$ magnitude variation as a function of the frequency for two piezoelectric states, according to an embodiment of the invention.
Figure 15:
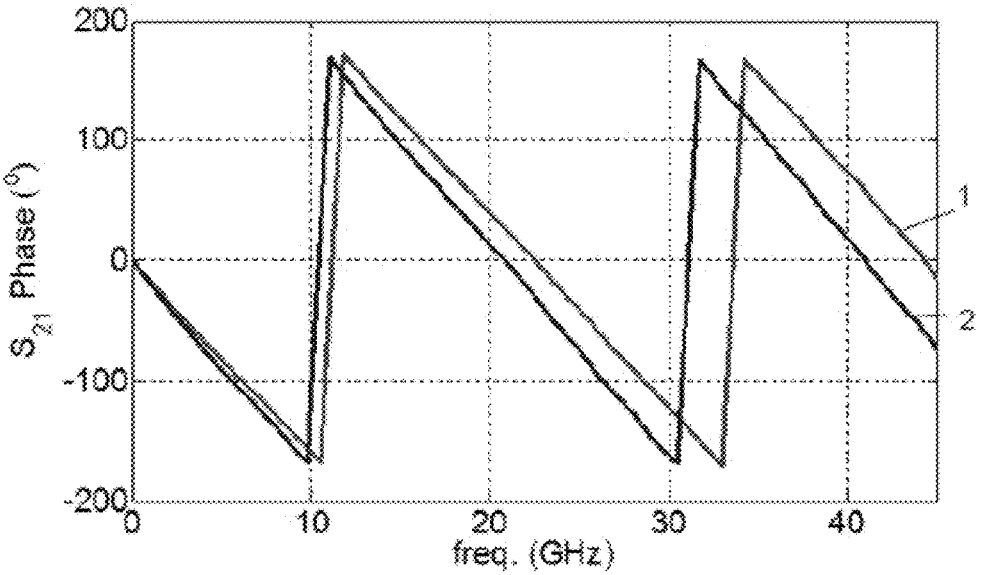
FIG. 15 provides a measured phase of $S_{21}$ as a function of the frequency for two piezoelectric states, according to an embodiment of the invention.

The results of this example can be presented for two extreme states of the piezoelectric transducer 302 that may be used: 1) the state when no voltage is applied whereby the piezoelectric transducer 302 has zero displacement resulting in a maximum air gap 308 between the CPW transmission line 310 and the BLT slab 306; and 2) the state when 60V is applied whereby the piezoelectric transducer 302 has a displacement of 11 μm which corresponds to a maximum air gap 308. A BLT slab 306 with a dielectric constant of 60 and a length of 4 mm is tested. A straight line segment of CPW transmission line 310 is used in this test. However, other types of CPW transmission lines can be used. FIG. 14 shows measured magnitude variations (in dB) of the insertion and the return loss $S_{21}$ and $S_{11}$ as a function of the frequency (in GHz) for two piezoelectric states, the first state (state 1) with zero displacement (the maximum air gap) and the second state (state 2) with a 11 μm displacement (the minimum air gap). FIG. 15 shows the measured phase variations (in°) of $S_{21}$ as a function of the frequency (in GHz) for the two piezoelectric states 1 and 2.

Example 4

Figure 16:
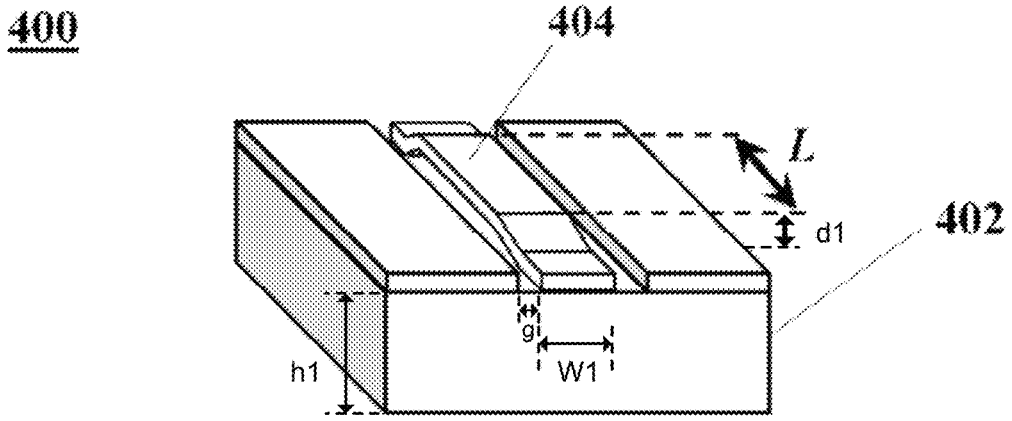
FIG. 16 provides a 3D model according to an embodiment of the invention.

According to the design of this example, a phase shifter 400 is provided that can be used at frequency 30 GHz. As illustrated in FIG. 16, the second dielectric is air or vacuum therefore parameters d2 and h2 referred to in FIG. 1 disappear. However, the air gap d1 between the transmission line 404 and the substrate 402 is adjustable which in turn is used to control the phase shift. HRS may be used as the substrate 402. According to this particular example, h1=500 um, W1=50 um, g=25 um and L=0.5 mm. The value of d1 may be controlled by an MEMS actuator using electromagnetic force.

According to this particular example, using an MEMS actuator, the obtained variation of d1 is 10 um deflection using 60 mW. The resultant phase shift at 30 GHz is 57°. Higher phase shift can be expected for substrates with higher dielectric constants.

Example 5

According to the design of this example, a phase shifter 500 is provided where a serpentine line type of CPW is used to achieve more phase shift within the same area. Such a phase shifter can be used in many applications where a compact phase shifter is desirable.

Figure 17:
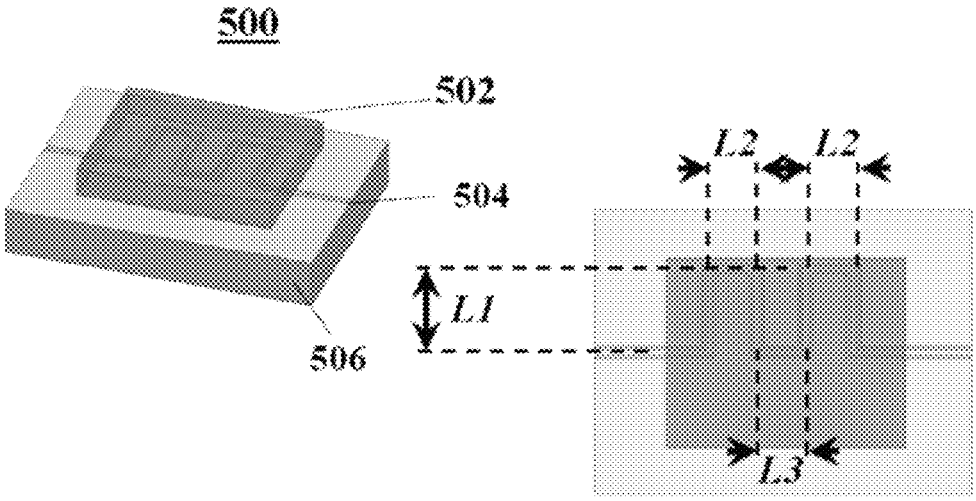
FIG. 17 provides a 3D model and a top view of the serpentine-CPW-based phase shifter, according to an embodiment of the invention.

As illustrated in FIG. 17 and similar to Example 1, the phase shifter 500 includes a dielectric slab 502 which is movable vertically with respect to the substrate 506. In this case, d2 is variable and d1 is fixed and zero. The difference between this example and Example 1 lies in configuration of the transmission line 504. In particular, the CPW transmission line in Example 1 is replaced with a serpentine type of CPW line. Since the introduced phase shift is proportional to the line length ($\Delta\varphi=\Delta\beta\times L$), using a serpentine type of CPW line will be a practical solution to achieve more phase shift within the same area. Serpentine lines have been used as delay lines, but are used in the phase shifter 500 to enhance the phase shifter performance.

The particular example as shown in FIG. 17 has a transmission line length which is 2.76 times longer than a straight CPW line within the same area. This, as will be shown later, leads to a significant increase in the maximum phase shift. According to this particular example, the sample design values of L1, L2 and L3 respectively are 1 mm, 0.45 mm and 0.45 mm. These lengths can be further optimized to meet other requirements.

Example 6

Figure 18:
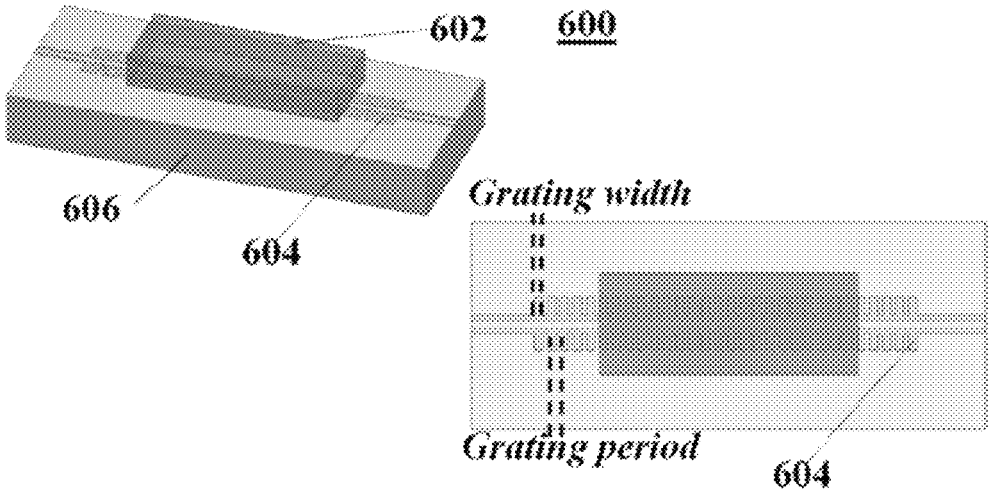
FIG. 18 provides a 3D model and a top view of the grating-CPW-based phase shifter, according to an embodiment of the invention.

According to the design of this example, a phase shifter 600 is provided includes a dielectric slab 602 which is movable vertically with respect to the substrate 606 and where a CPW with side grating is used for the planar transmission line 604. The grating CPW line 604 is a slow-wave CPW structure. This type of line increases the phase shift because of the increase in the wave propagation constant ($\beta$). As shown in FIG. 18, the grating line 604 is defined by two parameters, the grating width and the grating period. These two numbers can be optimized based on desired phase shift, given area, frequency, dielectric constants and other parameters. For this particular example, the grating width is 50 μm and the grating period is 80 μm. These values can be obtained by optimizing the previous CPW line for the maximum phase shift at 30 GHz using HFSS built-in optimizer.

Table 1 shows the simulations results for Examples 5 and 6 at 30 GHz using 5 mm long CPW lines loaded with a 2 mm long BLT slab having a dielectric constant of 80. The maximum phase shift is measured as the difference between the phase for the case where the air gap is large enough where the mode below the BLT slab is very similar to the CPW line mode (e.g., ≥100 um or removing the BLT slab), and that for the case where the air gap has a minimum practical value (e.g., <3 μm) and the mode is quite different from that of the CPW line without the perturber.

TABLE 1

Summary of Simulations at 30 GHz

| CPW type | Straight Line | Grating Example 4 | Serpentine Example 5 |
|---|---|---|---|
| Max. Phase | 85° | 122° | 267° |
| Average insertion loss | −1.13 dB | −1.35 dB | −1.66 dB |
| Insertion loss variation | 0.95 dB | 1.13 dB | 1.1 dB |
| Average return loss | −2.3 dB | −17.5 dB | −27 dB |

Example 7

According to the design of this example, the phase shifter according to some embodiments of the invention further includes a matching technique to enhance the bandwidth for various millimeter-wave wireless communication applications such as 60 GHz and 5G.

Figure 19:
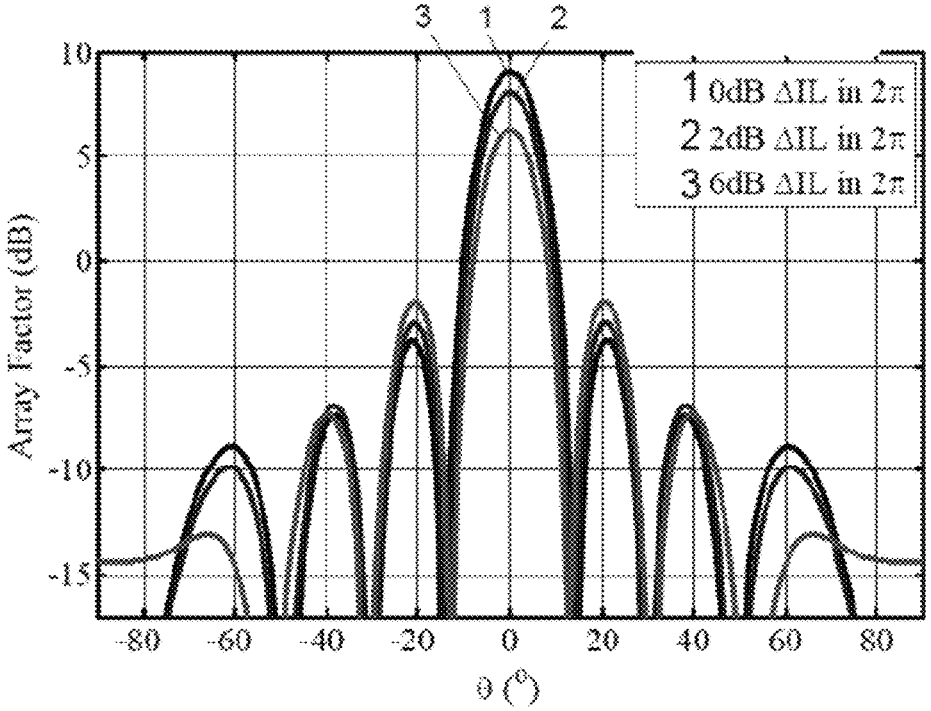
FIG. 19 provides an eight-element uniform Array Factor for different phase shifter performances.
Figure 20:
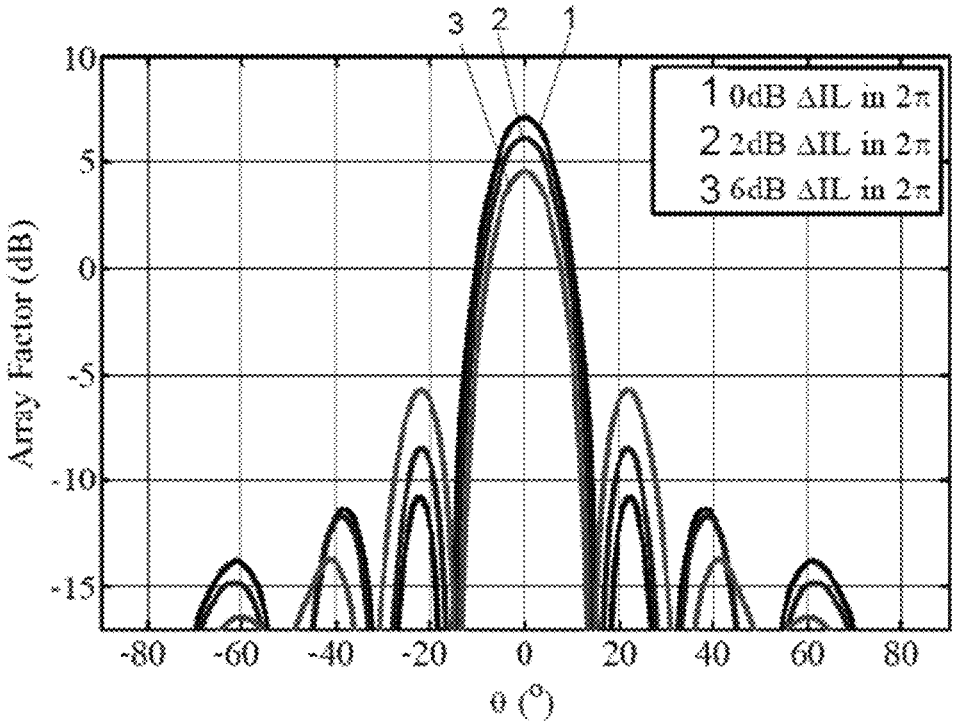
FIG. 20 provides an eight-element non-uniform Array Factor for different phase shifter performances.

The phase shifter insertion loss variation effect on antenna pattern can be shown in FIG. 19 which depicts the Array Factor (in dB) of eight-element antenna array as a function of the phase shift θ (in°) for different phase shifter characteristics (1 representing an ideal phase shifter which has 0 dB loss variation ΔIL in 2π, 2 representing a phase shifter with 2 dB loss variation ΔIL in 2 π, and 3 representing a phase shifter with 6 dB loss variation ΔIL in 2π). For non-uniform arrays which have very low Side Lobes Level (SLL), this effect can cause severe pattern distortion (as shown in FIG. 20). FIG. 20 shows the eight-element non-uniform Array Factor (in dB) as a function of the phase shift θ (in°) for the same phase shifter performances (1 representing an ideal phase shifter which has 0 dB loss variation ΔIL in 2π, 2 representing a phase shifter with 2 dB loss variation ΔIL in 2π, and 3 representing a phase shifter with 6 dB loss variation ΔIL in 2π). This effect may get worse while the beam is being steered to other angles.

Since the CPW loading with a high dielectric constant changes the propagating mode, it affects both the propagation constant (which leads to a significant phase shift) as well as the characteristic impedance (which leads to a mismatch that limits the bandwidth of the phase shifter).

The phase shifter according to this example uses the BLT phase shifter design such as those presented in the previous examples but further provides a matching section. According to one embodiment of the invention, the matching section is based on tapering the thickness of the dielectric slab.

Figure 21A:
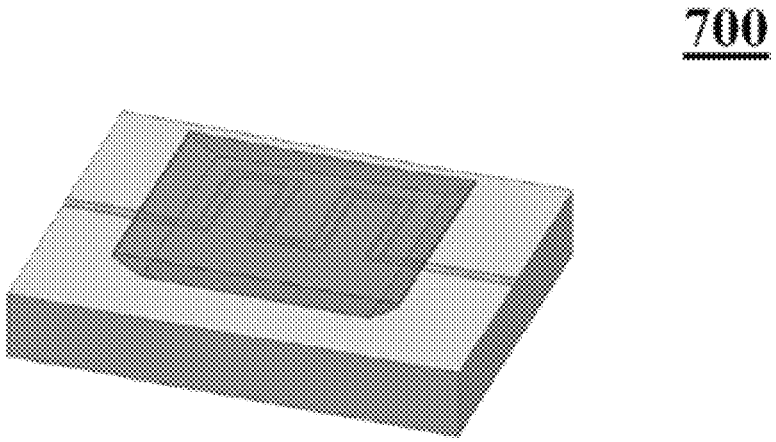
FIG. 21A provides a schematic diagram of a 3D model of the matching technique, according to an embodiment of the invention.
Figure 21B:
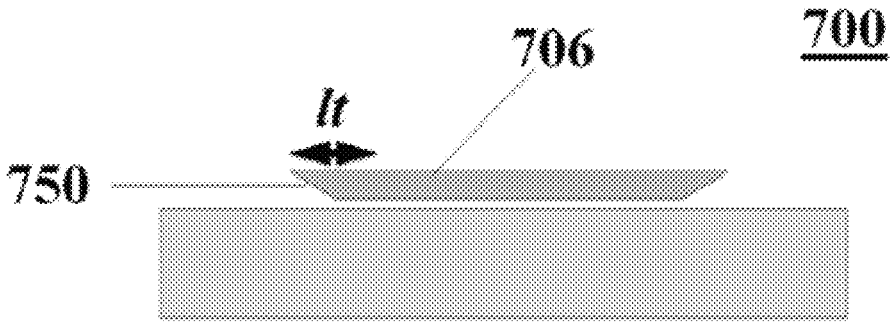
FIG. 21B provides a schematic diagram of the side view of the matching technique, according to an embodiment of the invention.

FIG. 21A and FIG. 21B show schematic diagrams of the matching section for the phase shifter 700. The matching section may include a tapered section 750 configured by tapering a dielectric slab 706 (FIG. 21B), e.g., a BLT dielectric slab. The tapered section 750 (FIG. 21B) may be tapered from one or both ends of the dielectric slab 706 in the longitudinal direction and may have a tapering length lt (FIG. 21B). This tapered section 750 can work as a smooth transition between low and high effective dielectric constants regions. The tapered section 750 can be implemented by sanding and polishing the dielectric slab 706 with a specific angle. The length of tapering can be controlled by measurements for a few iterations. The longer the tapered section 750 is, the better the matching that can be obtained; however, the maximum phase shift may be reduced. According to one particular embodiment, the optimal tapering length for a 4 mm slab of BLT with dielectric constant of 100 is found to be 1 mm using HFSS simulations. This optimization objective can be to minimize $S_{11}$ magnitude variation across the band while to maximize the phase shift.

The matching technique according to the embodiment reduces the mismatch introduced in the phase shifter and can be used with HRS CPW lines such as a straight CPW line, CPW line with side grating, or serpentine CPW line. The matching technique can also be extended to electrically controlled phase shifters.

According to the embodiment of the invention, the matching of the phase shifter 700 can be improved, by applying a linear tapering transition to the sides of the dielectric slab 706. In this particular example, a phase shifter with a length of 4 mm can achieve a phase shift of 360° at 33 GHz while the average insertion loss is 1.4 dB, and the bandwidth is more than 20 GHz.

Example 8

According to the design of this example, a MEMS planar phase shifter is provided for millimeter-wave/microwave applications, using a CPW structure fabricated directly on a high dielectric constant ceramic substrate. The MEMS planar phase shifter according to this example replaces the combination of a low dielectric constant carrying substrate and a high dielectric constant slab for the field perturbation. Phase shift is achieved by varying the gap between a suspended middle strip (i.e., CPW signal line) and the substrate. The use of a high dielectric constant substrate leads to a significant size reduction, which is desirable in practical applications.

Figure 22:
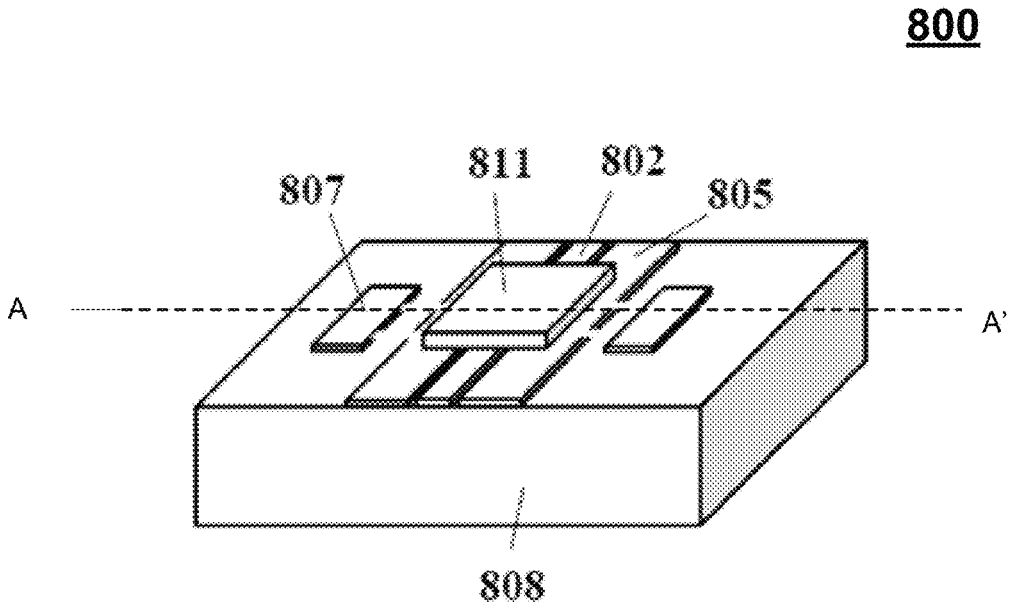
FIG. 22 provides an architecture of the MEMS phase shifter according to an embodiment of the invention.
Figure 23:
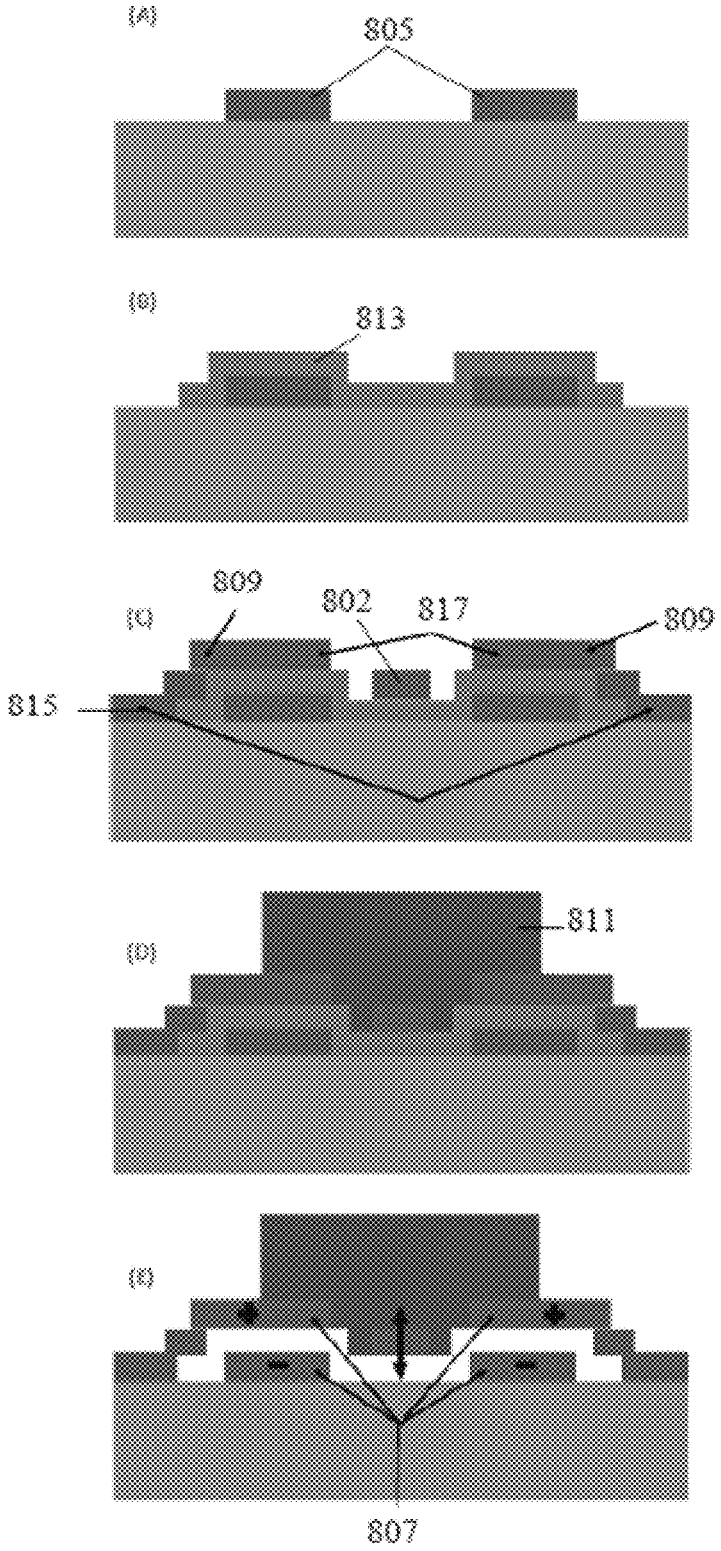
FIG. 23A to 23E provides main micro-fabrication steps of the phase shifter taking from cross-section A-A' in FIG. 22.

FIG. 22 provides an architecture of the MEMS phase shifter 800 according to an embodiment of the invention. The MEMS phase shifter 800 employs a CPW transmission line 802 on a high dielectric constant substrate 808 made of for example $BaO\text{-}Ln_2O_3\text{—}TiO_2$ (BLT) compounds. The propagation constant in the structure varies with the air gap between the CPW signal line 802 and its substrate 808. Such a change in the effective dielectric constant introduces a substantial change in the phase shift of the propagating wave with a small variation in the insertion loss. An insulating rigid membrane 811 is provided to allow actuation of the signal line 802.

According to one embodiment of the invention, the phase shifter 800 consists of two conducting layers, the first conductor layer for implementing CPW ground planes 805 and the second conductor layer for implementing the middle suspended strip 802 and the electrodes 807 for electrostatic actuation. An air gap of 1.2 μm between the two conducting layers may be adapted to control the propagating mode and the phase shift.

According to one embodiment of the invention, the micro-machining of the phase shifter 800 includes 4 photo-masks for micro-fabricating the MEMS planar phase shifter 800.

FIG. 23A to 23E illustrate the main fabrication steps in reference to the cross-section A-A' shown in FIG. 22. At step (A) a first mask is used to build CPW ground planes 805. According to this example, the conductor for the first layer may be 2 μm electroplated gold. A second mask is applied at step (B) for patterning a sacrificial layer 813 which may be a 1.2 μm silicon dioxide. The third mask is used at step (C) to pattern a second conducting layer that may be made of a 2 μm electroplated gold to implement the CPW signal line 802, isolated electrodes for actuation 817, suspensions 809, and actuation pads 815.

At step (D) the fourth photo-mask is then applied for patterning an insulating rigid membrane 811 that may be made of 10 μm polyimide. The main function of the insulating membrane 811 is to allow actuation of the signal line 802 by connecting the signal line 802 to actuation electrodes 807 mechanically while isolating it electrically from the actuation circuit. The second conductor (e.g., 2 μm gold) is also used to implement mechanical restoring force through the use of suspending micro-beams 809 as shown in FIG. 21. At step (E) the structures are released and electrodes 807 are actuated.

According to this example, a compact MEMS planar phase shifter 800 can be provided for mm-wave phased array applications. The phase shifter 800 employs a CPW transmission line with movable sections of its signal line 802. The CPW is built directly on a high dielectric constant BLT substrate 808 (e.g., $\varepsilon_r$=100) which can make the structure compact. The phase shifter 800 building block may be a section of 0.8 mm which measures a phase shift of 61° at 35 GHz. A measured cascade of four stages can provide a 250° phase shift with an average loss of 5.8 dB. The phase shifter is matched across the range from 31 GHz to 40 GHz. The design according to the example can achieve a good performance with the use of a dielectric substrate with a smaller loss tangent and much less surface roughness with better flatness.

Image Waveguide-Based Phase Shifter

According to another embodiment of the invention, a phase shifter based on an image waveguide is provided where a dielectric image waveguide is used instead of a CPW transmission line. Such a phase shifter is desirable for higher frequency millimeter-wave/sub-THz applications (e.g., ~60 GHz to sub-THz range), where phase is adjusted by changing the propagation constant of an image guide using a dielectric perturber.

Figure 24:
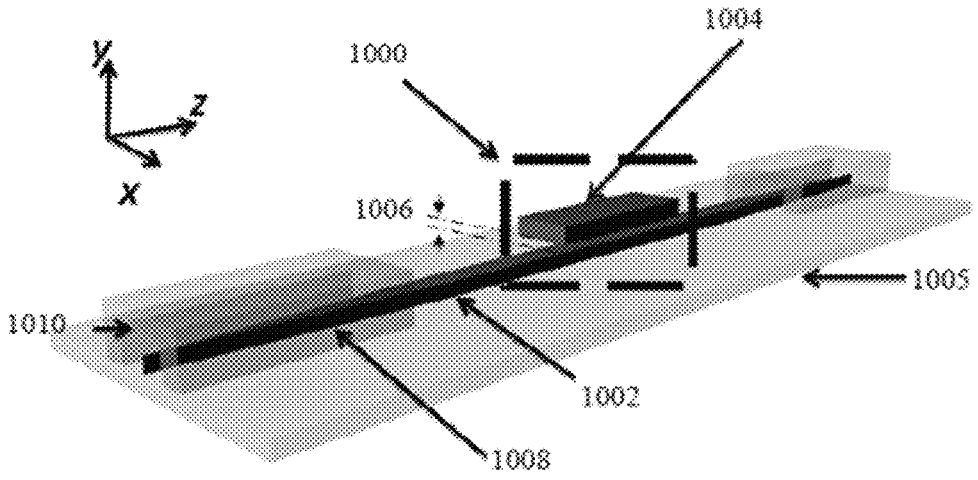
FIG. 24 provides a 3D model of an image-guide-based phase shifter, according to one embodiment of the invention.

FIG. 24 illustrates an image-guide-based phase shifter 1000 according to one embodiment of the invention. According to this embodiment, the phase guide 1000 includes a dielectric image guide 1002 along the z axis, such as a FIRS (e.g., ≥2 KΩcm) dielectric image waveguide. The image guide 1002 is built on ground 1005 which is along the x-z plane. A dielectric perturber (e.g., BLT slab) 1004 is used to create an air gap 1006 between the dielectric perturber 1004 and the image waveguide 1002 along the y axis. The phase shifter 1000 is the region indicated with dotted line. FIG. 24 also illustrates a transition 1008 to WR10 1010 for waveguide-based testing purposes, but the transition 1008 is not included in the phase shifter 1000. The phase shifter 1000 may be part of a homogenous image-guide-based phased array antenna system or integrated directly to flip-chip-based active components through image guide to CPW transition without a tapered transition. Therefore, the phase shifter 1000 actual size does not include the transition 1008 or a tapered transition length.

According to the embodiment of the invention, HRS material may be used for the image guide 1002 because it is desirable for millimeter-wave/sub-THz antenna systems due to its ability to reduce fabrication process cost, complexity, and/or power loss in the guiding structure, and to form a fully homogenous low-cost/low-loss platform suitable for millimeter-wave/sub-THz antenna system that can be easily integrated with active devices in this range of frequencies.

The propagating mode and the propagation constant of the dielectric image waveguide 1002 is changed by placing a high dielectric constant BLT material 1004 on top of the image waveguide 1002 at a small distance (a few microns). A variation of the phase shift is obtained by changing the air gap 1006. BLT material is used for the dielectric perturber 1004 to provide high dielectric constant for size reduction. According to some embodiments, BLT materials with dielectric constants up to εr=165 may be used.

Figure 25:
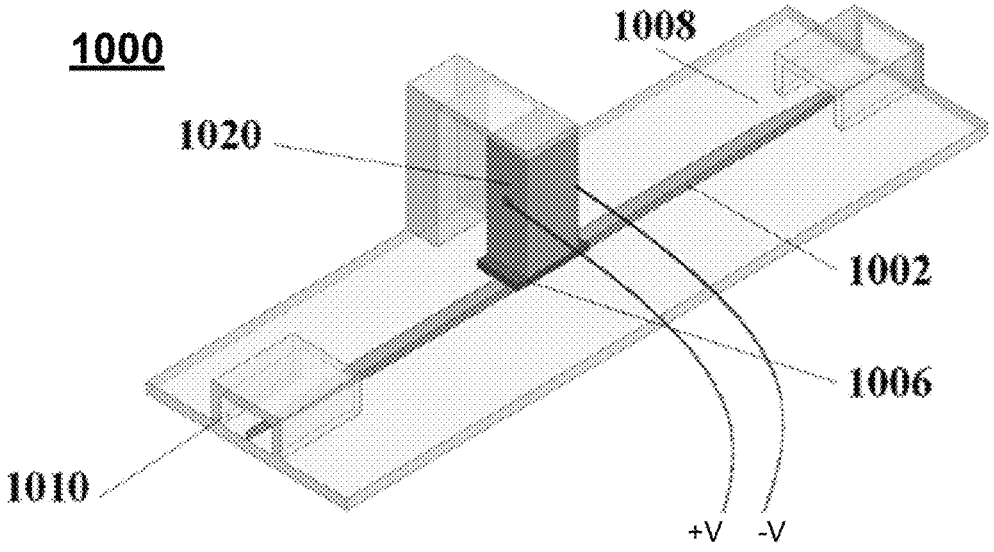
FIG. 25 provides a 3D model of an example of the image-guide-based phase shifter including a piezoelectric transducer, according to one embodiment of the invention.

Piezoelectric actuators can be used to vary the air gap 1006 with micron accuracy. According to one embodiment of the invention, a low cost fabrication technology is developed and used to realize the phase shifter 1000 in FIG. 25. An example of the image-guide-based phase shifter including a piezoelectric transducer 1020 is shown in FIG. 25. The two sides of the piezoelectric transducer 1020 are connected respectively to driving voltages +V and −V. For scattering parameter measurements, the HRS image guide 1002 may have tapered transitions 1008 to the WR10 waveguide ports 1010 of the PNA-X millimeter-wave head extender modules at both ends. The phase shifter 1000 operates in the W-band and uses the piezoelectric transducer 1020 to control the air gap 1006.

Figure 26:
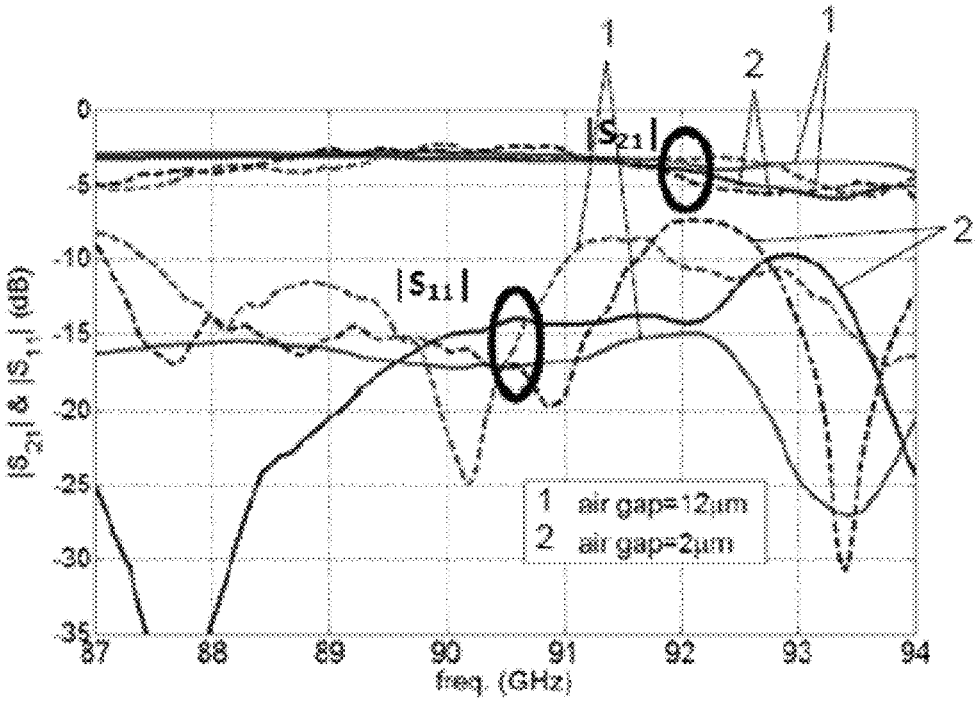
FIG. 26 provides $|S_{11}|$ and $|S_{12}|$ of FIG. 24 for two different states of the piezoelectric transducer, according to one embodiment of the invention.
Figure 27:
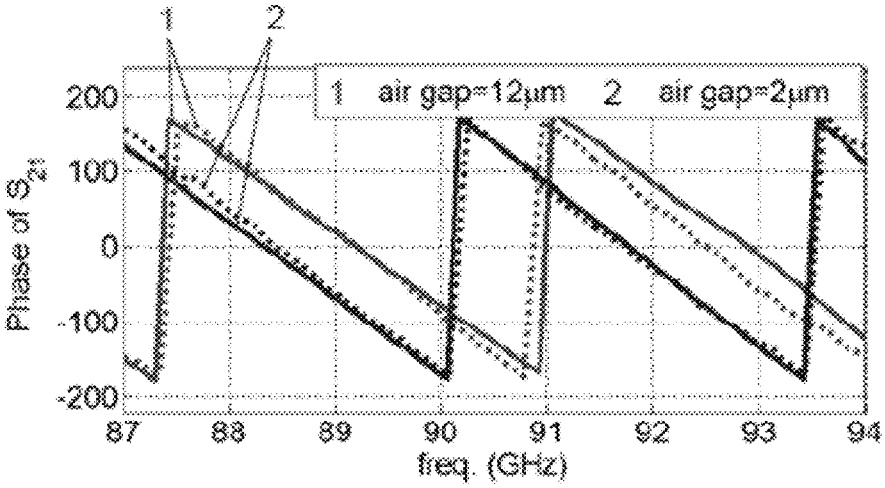
FIG. 27 provides a measured phase shift of FIG. 24 for two different states of the piezoelectric transducer, according to one embodiment of the invention.

According to one particular example, the image guide 1002 has a width of 700 μm, a thickness of 500 μm and a length of 20 mm. The HRS has a dielectric constant of 11.8 and a resistivity of 2KΩ·cm. The dielectric slab is 500 μm thick and has a length of 4 mm. According to the example, the dielectric slab used with the piezoelectric transducer 1020 has a dielectric constant of εr=250. If higher phase shift is desired, longer slabs or slabs with higher dielectric constant can be used. Some results are shown in FIGS. 26 and 27. FIG. 26 shows measured magnitude variations (in dB) of $|S_{11}|$ and $|S_{12}|$ of FIG. 24, as a function of the frequency (in GHz) for two different states of the piezoelectric transducer, the first state (state 1) for an air gap of 12 μm and the second state (state 2) for an air gap of 2 μm. FIG. 27 shows the measured phase variations (in°) of $S_{21}$ of FIG. 24 as a function of frequency (in GHz) the two different piezoelectric states 1 (12 μm) and 2 (2 μm). The measurement results are shown in dotted lines while the simulation results are shown in solid ones.

According to one embodiment of the invention, an optical lithography and dry etching process is used to fabricate the image guide 1002.

Figure 28:
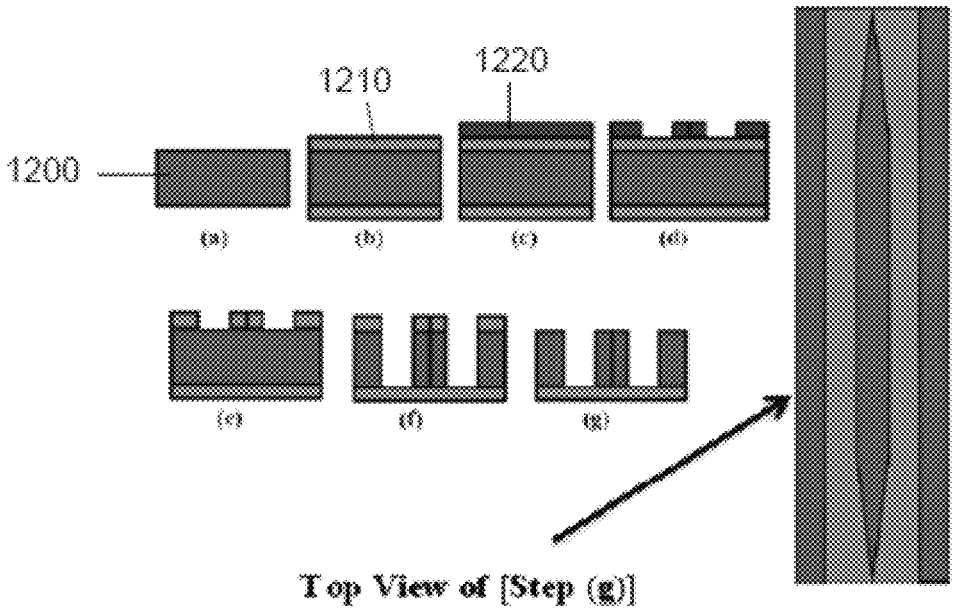
FIG. 28 provides an optical lithography fabrication process of the image-guide-based phase shifter, according to one embodiment of the invention.

The fabrication method includes a single-mask fabrication process including standard steps and recipes, which may achieve low production cost and a high level of reproducibility. The chosen substrate wafer may be double-sided polished and has an orientation of [1 0 0] with a diameter and thickness of 4 inch and 500 μm respectively. The process steps can be summarized as shown in FIG. 28. In Step (a), the high resistivity silicon wafer 1200 is cleaned in RCA solution. In Step (b), an Aluminum layer 1210 with thickness of for example 0.5 um is sputtered on each side of the silicon substrate 1200. Then at Step (c) the wafer is coated with a thin layer 1220 of photo-resist (Shiply 1811) with a thickness of for example about 1.3 um on one side (above the Aluminum layer 1210).

In Step (d), an optical lithography with a 5-inch Chrome mask (e.g., Sum resolution) is performed. Then in Step (e) the Aluminum layer 1210 is patterned using the wet etching process. In Step (f), Deep Reactive-Ion-Etching (DRIE) (Standard Bosch process) is performed for the thickness of for example 500 um (a carrier wafer is used during the through wafer etching). Subsequently in Step (g) the Aluminum hard mask is stripped with the Aluminum wet etchant again. A top view of step (g) is also illustrated in FIG. 28.

One of the advantages of this technique is its high-dimensional accuracy obtained from the photolithography and DRIE processes. With photolithography, depending on the quality of the Chrome mask, very small tolerances up to ±0.3 μm may be realizable. The DRIE process is able to provide almost vertical sidewalls with a small roughness. The measured width of the fabricated waveguide is 700±2 μm. The roughness of the Silicon surface can be measured by a profiler. The standard deviation value of the surface roughness may be 13 nm.

According to one embodiment of the invention, the fabrication process includes a Laser micro-machining process used to construct the BLT slab 1004.

This fabrication method is based on laser machining, which can be an accurate, chemical-free, and fast process (no mask preparation is needed) used as an alternative solution to etching technique in many emerging applications. A ProtoLaser U3 UV system from LPKF can be used as the laser machine for cutting the BLT samples. The laser wavelength is in this example is 355 nm. The standard deviation value of the surface roughness is 79 nm.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

What is claimed is:

1. A tunable phase shifter, comprising:

a dielectric substrate;

a coplanar waveguide (CPW) transmission line formed above the dielectric substrate for carrying input and output signals;

a dielectric perturber placed above the transmission line; and a phase shifting mechanism for adjusting at least one of a distance between the transmission line and the substrate and a distance between the transmission line and the dielectric perturber to effect phase shift, wherein the dielectric constant of the dielectric perturber is in a range of 40-170 and signals propagating on the CPW transmission line are converted into a new propagation mode which is confined in a region between the CPW transmission line and the dielectric perturber.

2. The tunable phase shifter according to claim 1, wherein the dielectric perturber is air.

3. The tunable phase shifter according to claim 1, wherein the distance between the transmission line and the substrate is zero.

4. The tunable phase shifter according to claim 1, wherein the phase shifting mechanism includes a movement mechanism for moving at least one of the transmission line and the dielectric perturber.

5. The tunable phase shifter according to claim 4, wherein the movement mechanism includes a micro-positioner.

6. The tunable phase shifter according to claim 4, wherein the movement mechanism includes a piezoelectric transducer.

7. The tunable phase shifter according to claim 4, wherein the movement mechanism includes a micro-electromechanical systems (MEMS) actuator.

8. The tunable phase shifter according to claim 4, wherein the movement mechanism is electrically controlled.

9. The tunable phase shifter according to claim 1, wherein the transmission line is a serpentine CPW line.

10. The tunable phase shifter according to claim 1, wherein the transmission line is a grating CPW line.

11. The tunable phase shifting according to claim 1, further comprising a matching section to provide wide band characteristics.

12. The tunable phase shifting according to claim 11, wherein the matching section includes a tapered section formed at an end of the dielectric perturber.

13. A tunable phase shifter, comprising:

a dielectric substrate;

a coplanar waveguide (CPW) transmission line formed above the dielectric substrate for carrying input and output signals;

a dielectric perturber placed above the transmission line, and a phase shifting mechanism for adjusting at least one of a distance between the transmission line and the substrate and a distance between the transmission line and the dielectric perturber to effect phase shift, wherein the dielectric perturber is a Barium Lanthanide Tetratitanates (BLT)-based slab.

14. The tunable phase shifter according to claim 13, wherein the phase shifting mechanism adjusts the distance between the CPW transmission line and the dielectric perturber by controlling a voltage applied to a voltage controllable actuator attached to the dielectric perturber to introduce a change in the distance between the CPW transmission line and the dielectric perturber.

* * * * *